US006073645A

United States Patent [19]

Wu

[11] Patent Number: 6,073,645

[45] Date of Patent: Jun. 13, 2000

[54] PUMPING DEVICE WITH AN INTERNAL PIVOTAL TUBE FOR VARIOUS VALVES

[76] Inventor: Scott Wu, P.O. Box 63-247, Taichung, Taiwan

[21] Appl. No.: 09/276,075

[22] Filed: Mar. 25, 1999

[51] Int. Cl.[7] ..... F16K 15/20

[52] U.S. Cl. ..... 137/231; 137/270; 137/223

[58] Field of Search ..... 137/223, 231, 137/270, 269

[56] References Cited

U.S. PATENT DOCUMENTS

| | | | |
|---|---|---|---|
| 5,379,796 | 1/1995 | Wang | 137/231 |
| 5,683,234 | 11/1997 | Chuang et al. | 417/531 |
| 5,762,095 | 6/1998 | Gapinski et al. | 137/223 |
| 5,819,781 | 10/1998 | Wu | 137/231 |
| 5,960,815 | 10/1999 | Wang | 137/118.03 |
| 5,975,109 | 11/1999 | Wu | 137/231 |

*Primary Examiner*—John Rivell
*Assistant Examiner*—Meredith H. Schoenfeld
*Attorney, Agent, or Firm*—Alan Kamrath; Oppenheimer Wolff & Donnelly LLC

[57] ABSTRACT

A pumping device includes a main body having a passage defined therein through which air passes, a head, and a pivotal tube secured to the main body and rotatably received in a first end of the head. A second end of the head is communicated with the passage. The pivotal tube includes a hollow cam seat securely mounted therein. The cam seat includes a central rotating axis relative to the first end of the head. The cam seat further includes a first side with a first opening and a second side with a second opening communicated with the first opening. A distance from the central rotating axis of the cam seat to the first side is smaller than a distance from the central rotating axis of the cam seat to the second side. A retainer slidably received in the head and including a first compartment therein. A second end of the retainer includes a conical recess defined therein. A spring is mounted in the first compartment. A nozzle is slidably mounted in the second end of the retainer and includes an end attached to the spring. A pin is slidably mounted in the retainer and includes a first end extended beyond a first end of the retainer and a second end secured to the nozzle to slide therewith. The second opening of the cam seat is sized to prevent the first end of the pin from passing through the second opening, and the first opening of the cam seat is sized to allow the first end of the pin to pass through. A nozzle head is securely mounted in the second end of the head and includes a second compartment communicated with the first compartment via the nozzle. The nozzle head includes a hollow conical section for engaging with the conical recess of the retainer.

5 Claims, 8 Drawing Sheets

A-A

B-B

PUMPING DEVICE WITH AN INTERNAL PIVOTAL TUBE FOR VARIOUS VALVES

BACKGROUND OF THE INVENTION

1. Field of the Invention

The present invention relates to a pumping device, and more particularly to a pumping device that includes an internal pivotal tube for various valves without the need of visual discrimination of the types of the valves.

2. Description of the Related Art

Various pumping devices have heretofore been provided for inflating bicycle tires. Since there are many kinds of valves for bicycle tires, e.g., French valve, Japanese valve, and American valve, a so-called "double head" type pump with a switch means have been proposed to be used on these different valves. Nevertheless, the conventional pumping devices generally have complicated structures and require troublesome operation to suit different valves. U.S. Pat. No. 5,819,781 to Wu issued on Oct. 13, 1998 discloses a pumping device with a pivotal lever for various valves that can be successfully used on different valves, yet troublesome operation of the pivotal lever is still required. The present invention is intended to provide a pumping device that can be used without the need of visual discrimination of the types of the valves to be inflated.

SUMMARY OF THE INVENTION

It is a primary object of the present invention to provide a pumping device that has an internal pivotal tube for various valves without visual discrimination of the types of the valves to be inflated.

A pumping device in accordance with the present invention comprises:

a main body having a passage defined therein through which air passes, a head including a first end and a second end, the second end of the head being communicated with the passage, a pivotal tube secured to the main body and rotatably received in the first end of the head, the pivotal tube including a hollow cam seat securely mounted therein, the cam seat including a central rotating axis relative to the first end of the head, the cam seat including a first side with a first opening and a second side with a second opening communicated with the first opening, a distance from the central rotating axis of the cam seat to the first side being smaller than a distance from the central rotating axis of the cam seat to the second side, a retainer slidably received in the head and including a first compartment therein, a first end, and a second end, the second end of the retainer including a conical recess defined therein, a spring being mounted in the first compartment, a nozzle being slidably mounted in the second end of the retainer and including a first end attached to the spring and a second end, a pin being slidably mounted in the retainer and including a first end extended beyond the first end of the retainer and a second end secured to the nozzle to slide therewith, the second opening of the cam seat being sized to be smaller than the first end of the pin to prevent the first end of the pin from passing through the second opening, the first opening of the cam seat being sized to be larger that the first end of the pin to allow the first end of the pin to pass through, and a nozzle head securely mounted in the second end of the head and including a second compartment communicated with the first compartment via the nozzle, the nozzle head including a hollow conical section for engaging with the conical recess of the retainer.

In an embodiment of the invention, the retainer includes a transverse hole for communicating the first compartment of the retainer and the passage of the main body. The pin includes a second transverse hole communicated with the first-mentioned transverse hole via the first compartment of the retainer. The pin further includes an axial hole that communicates the second transverse hole with the second end of the nozzle.

The passage of the main body may include a check valve mounted therein such that air is only flowable from the passage to the first compartment.

An outer cap is securely mounted to the second end of the head to secure the nozzle head in position. The outer cap includes an opening communicated with the second compartment of the nozzle head.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
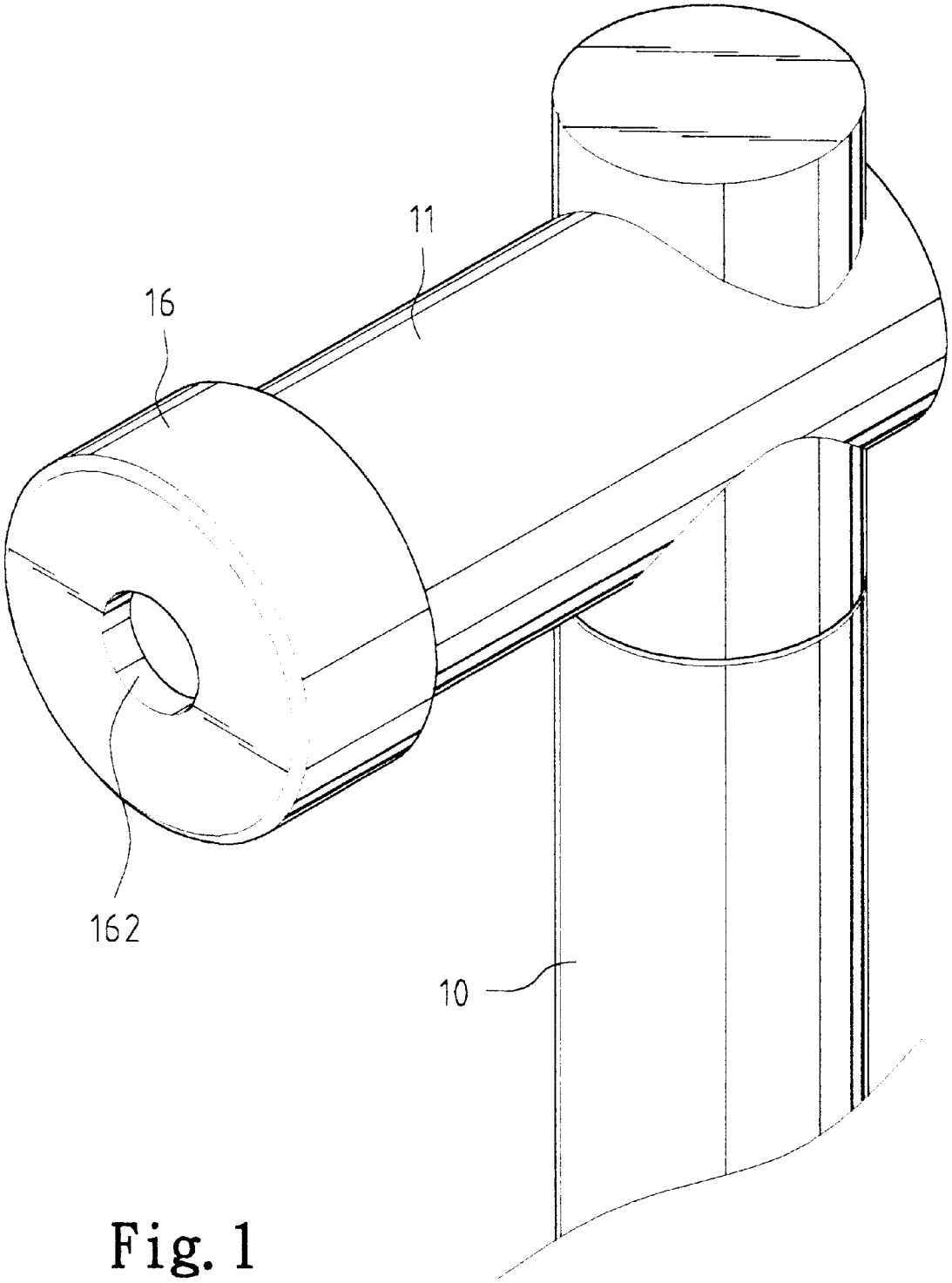
FIG. 1 is a partial perspective view of a pumping device in accordance with the present invention.
Figure 2:
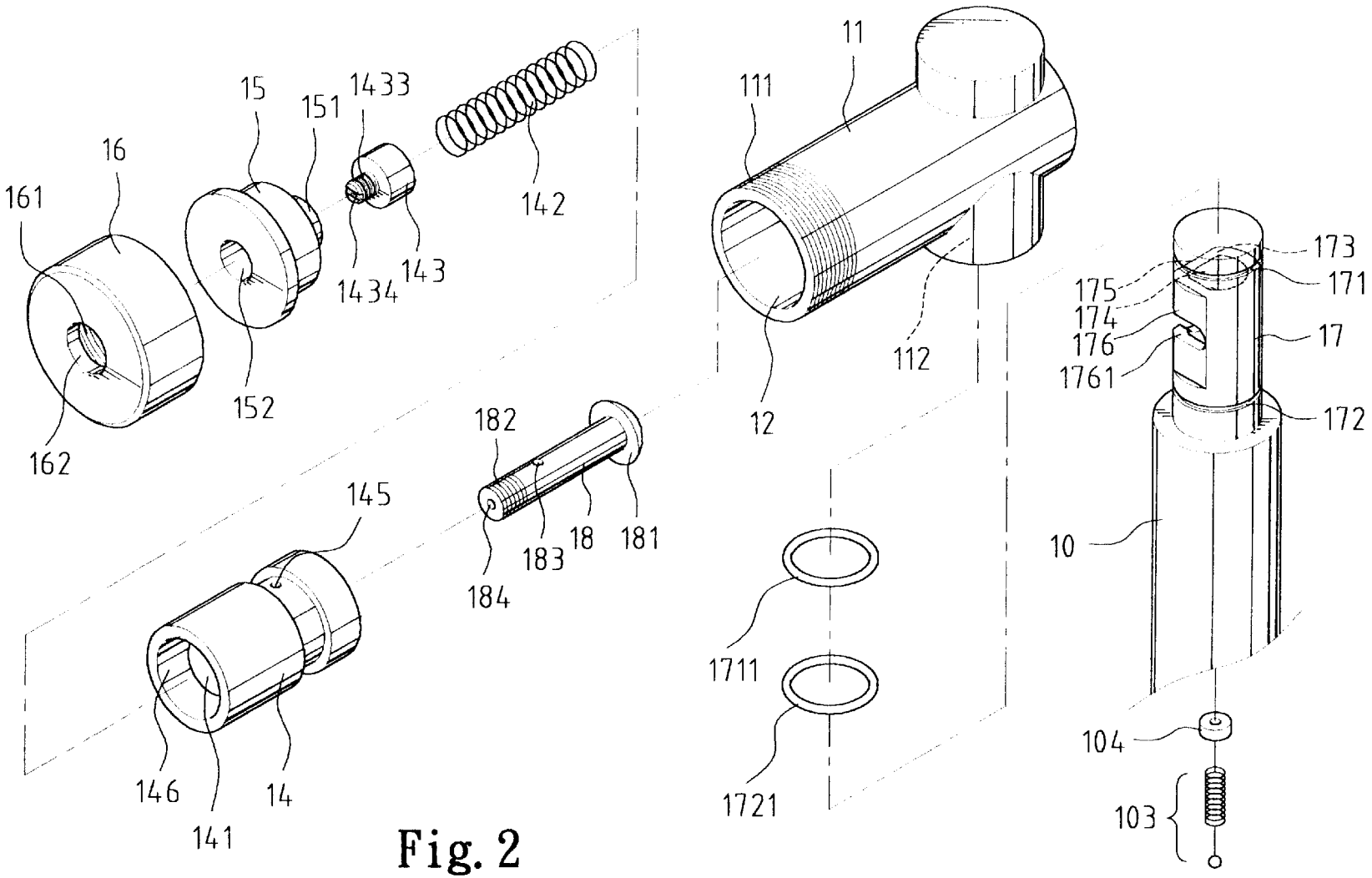
FIG. 2 is an exploded perspective view of the pumping device in accordance with the present invention.
Figure 6:
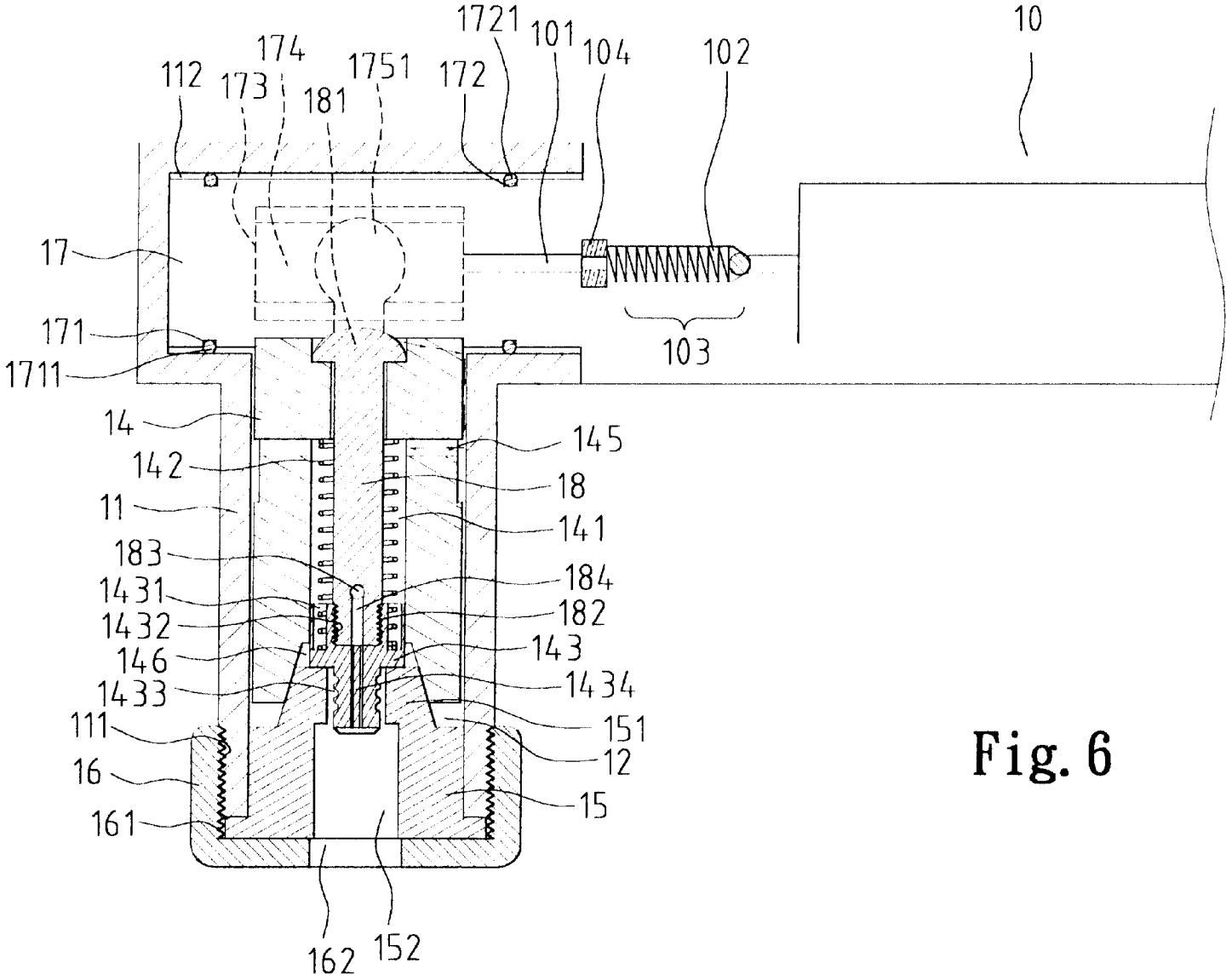
FIG. 6 is a cross sectional view of the pumping device in accordance with the present invention.

Referring to the drawings and initially to FIGS. 1, 2, and 6, a pumping device for bicycles tires in accordance with the present invention generally includes a main body 10 having a passage 101 defined therein and a head 11 connected to the main body 10. The passage 11 is communicated to a chamber (not labeled, see FIG. 6) which receives a piston (not shown) therein for pumping air into the passage 101. Structure and operation of the piston are conventional and therefore not described in detail.

As shown in FIG. 6, the passage 101 includes a check valve 103 mounted therein such that air is only flowable from the passage 101 to the head 11. In this embodiment, the passage 101 includes an enlarged section 102, and the check valve 103 includes a spring, a ball, and a holed cap 104 to which the spring (not labeled) bears against. The main body 10 further includes a pivotal tube 17 projected from an end thereof, which will be described later. The head 11 includes a first end having a first compartment 112 for rotatably receiving the pivotal tube 17 and a second end having a second compartment 12 that communicates with the passage 101.

Still referring to FIGS. 2 and 6, a retainer 14 is slidably received in the second compartment 12 of the head 11. The retainer 14 includes a transverse hole 145 in a periphery thereof and a third compartment 141 that communicates with the transverse hole 145 and that receives a spring 142 and a nozzle 143 therein. The retainer 14 further includes a conical recess 146 defined in an end thereof.

The nozzle 143 includes a recess 1431 (FIG. 6) defined in a first end thereof for receiving an end of the spring 142. The first end of the nozzle 143 further includes a notch 1432 defined therein, and a second end of the nozzle 143 includes a plurality of annular groove 1433 defined in an outer periphery thereof and a needle 1434 therein. As shown in FIG. 6, the second end of the nozzle 143 extends in the conical recess 146 of the retainer 14.

A nozzle head 15, preferably of plastic material, is mounted in the second end of the head 11 and includes a compartment 152 which communicates with the compartment 141 of the retainer 14 and which may receive a valve of a bicycle tire which will be further described. The nozzle head 15 further includes a conical section 151 having an outer curvature complimentary to the conical recess 146 of the retainer 14 so as to be fittingly received in the conical recess 146. As shown in FIG. 6, the conical section 151 is hollow so as to allow the second end of the retainer 14 to extend.

An outer cap 16 is mounted to enclose the second end of the head 11 by threading engagement 161, 111. The outer cap 16 includes an opening 162 defined therein through which the valve of the bicycle tire may pass.

Still referring to FIGS. 2 and 6, a pin 18 is slidably extended through the retainer 14 and includes an enlarged first end 181 beyond the first end of the retainer 14. The first end of the retainer 14 may include a recessed section (not labeled) to receive the enlarged first end 181 of the pin 18. A second end of the pin 18 is secured in the recess 1432 of the nozzle 143 by threading engagement 182 such that the pin 18 and the nozzle 143 move together. The pin 18 further includes a transverse hole 183 that communicates with the compartment 141 of the retainer 14, and an axial hole 184 is defined in the second end of the pin 18 to communicate the transverse hole 183 with the needle 1433 of the nozzle 143.

Figure 3:
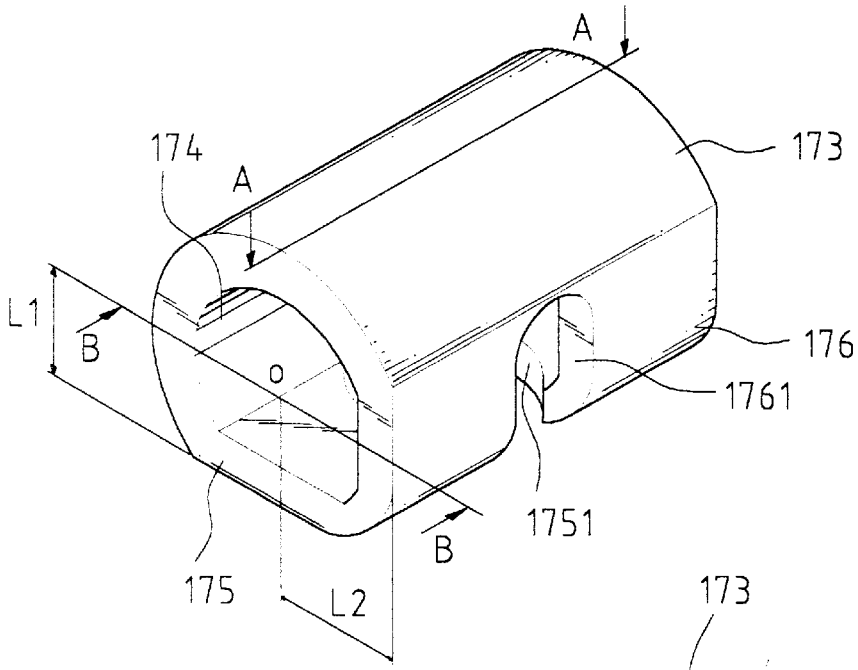
FIG. 3 is a perspective view of a cam seat of a pivotal tube of the pumping device in accordance with the present invention.
Figure 4:
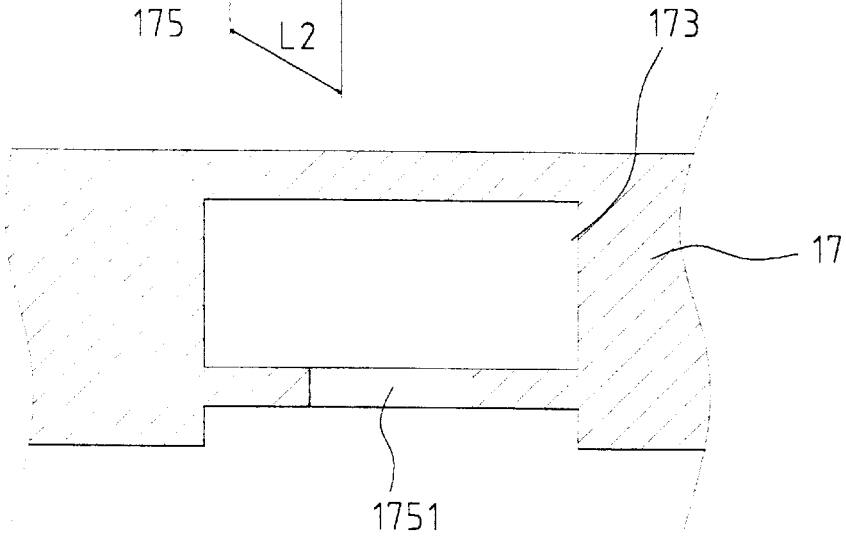
FIG. 4 is an enlarged sectional view of the cam member taken along line A—A in FIG. 3.
Figure 5:
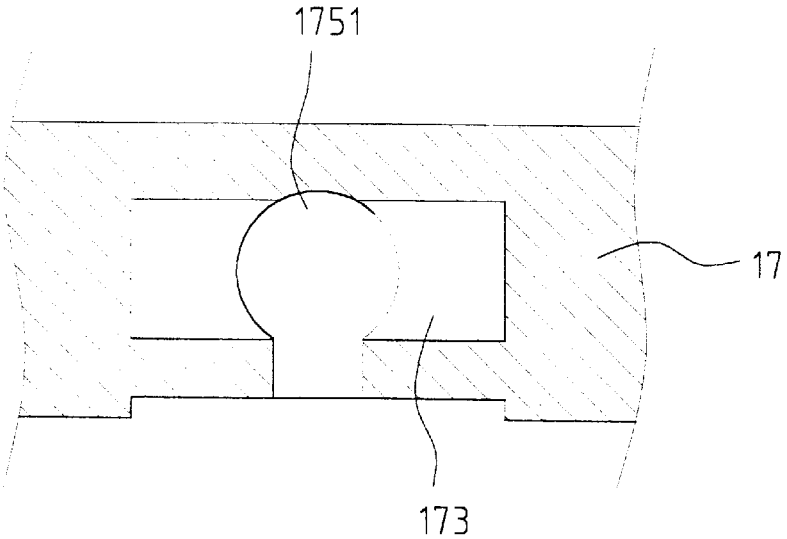
FIG. 5 is an enlarged sectional view of the cam member taken along line B—B in FIG. 3.

Referring to FIGS. 2 and 3, the pivotal tube 17 secured to the main body 10 is rotatably received in the first compartment 112 of the head 11. The pivotal tube 17 includes two annular grooves 171 and 172 in two ends of an outer periphery thereof for receiving O-rings 1711 and 1721 to provide a sealing effect, best shown in FIG. 6. The pivotal tube 17 further includes a hollow cam seat 173 (with an interior 174) securely mounted therein. Referring to FIGS. 3, 4, and 5, the cam seat 173 includes a first side 175 with a first opening 1751 that allows the enlarged first end 181 of the pin 18 to pass through. The cam seat 173 further includes a second side 176 that is adjacent to the first side 175 and that has a second opening 1761 communicated with the first opening 1751. The second opening 1761 is sized to be smaller than the enlarged first end 181 of the pin 18 to prevent the enlarged first end 181 of the pin 18 from passing through the second opening 1761. The remaining peripheral wall portion (not labeled) of the cam seat 173 includes a central rotational axis C about which the cam seat 173 rotates relative to the first end of the head 11. As can be seen from FIG. 3, a distance L1 from the central rotating axis C of the cam seat 173 to the first side 175 is smaller than a distance L2 from the central rotating axis C of the cam seat 173 to the second side 176. It is appreciated that the compartment 12 of the head 11 communicates with the passage 101 via the cam seat 173. Nevertheless, the compartment 12 of the head 11 can be communicated with the passage 101 by other suitable passages.

Figure 7:
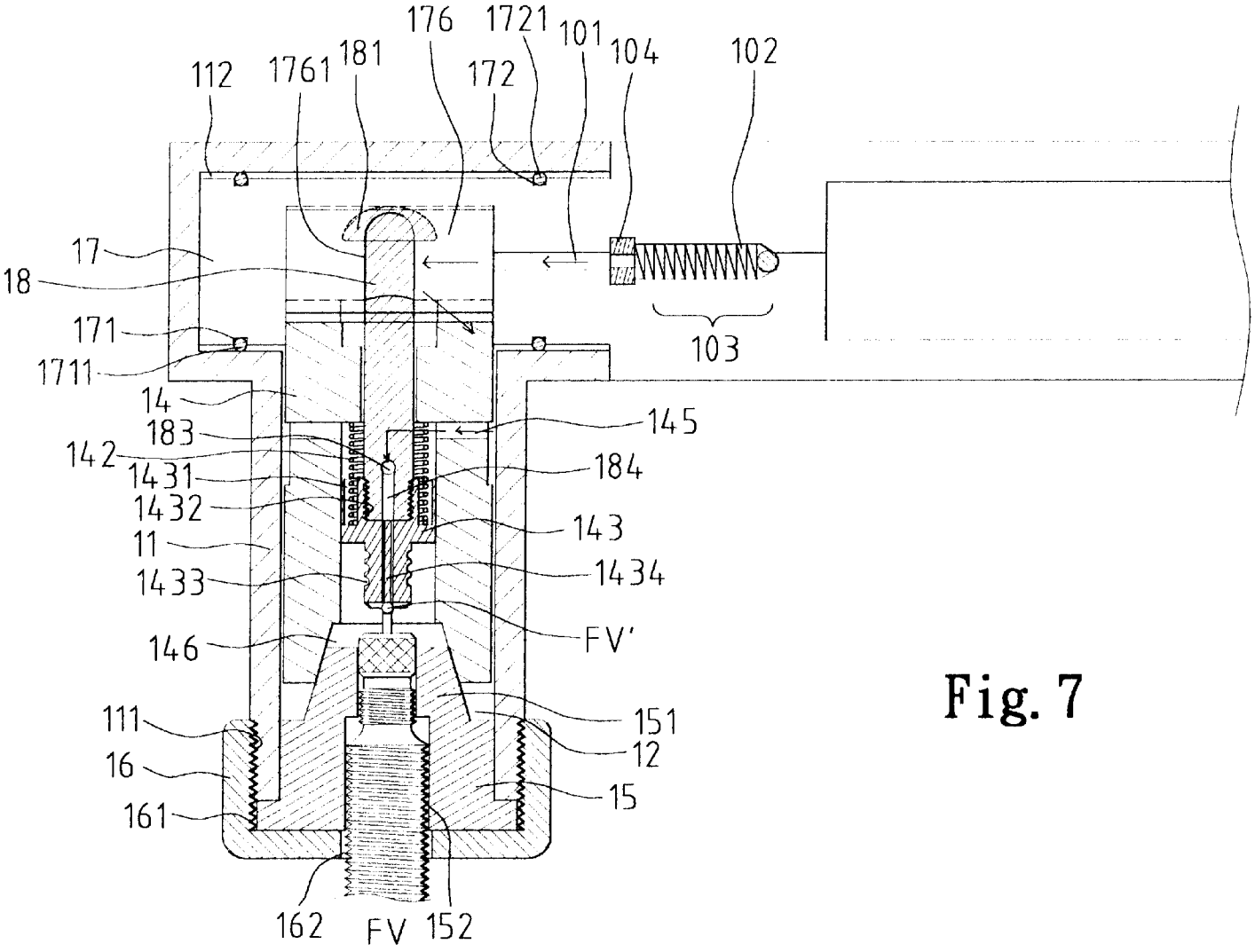
FIG. 7 is a cross sectional view of the pumping device in accordance with the present invention used on a French valve.
Figure 8:
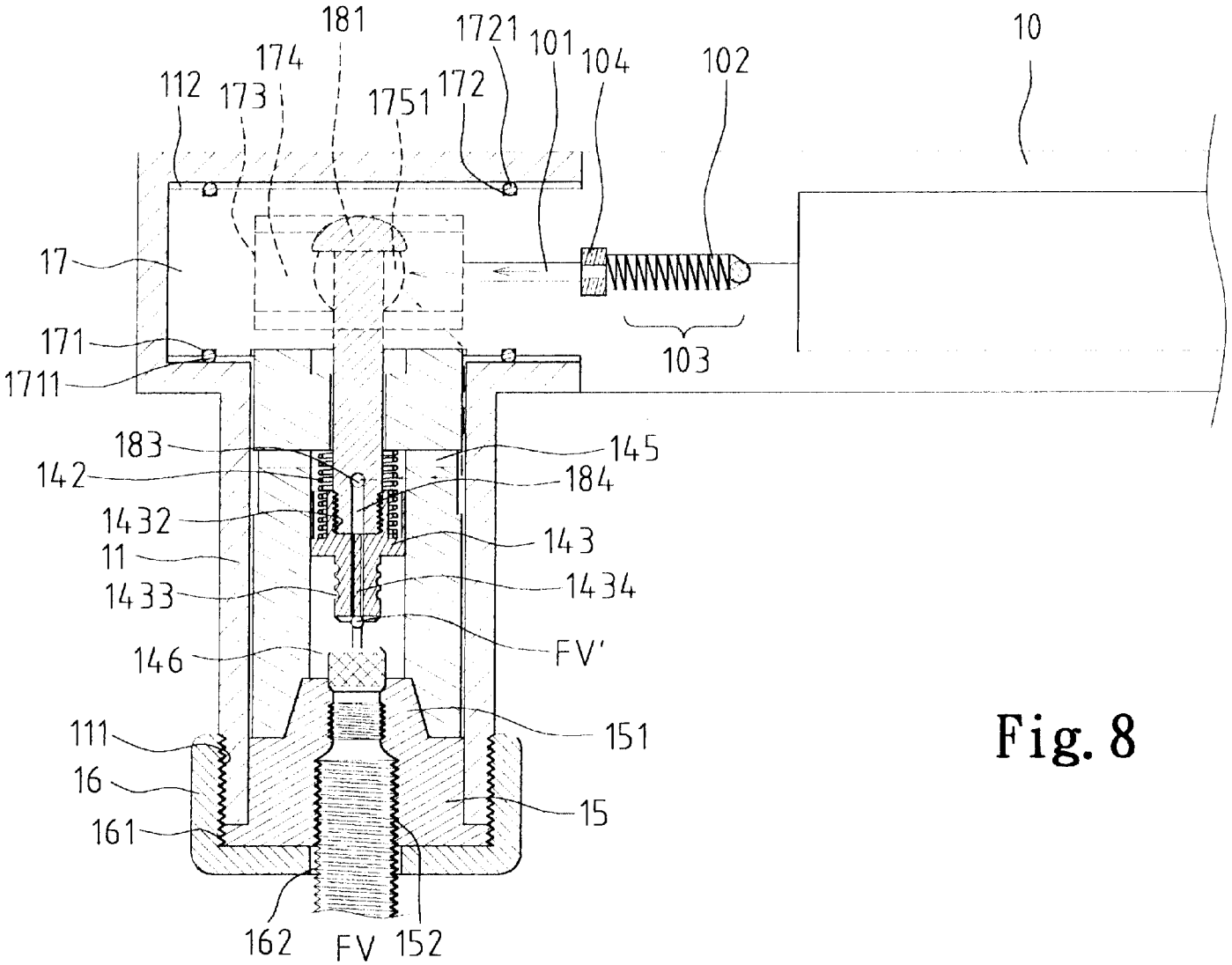
FIG. 8 is a cross sectional view similar to FIG. 7, wherein the French valve is tightly clamped.

In operation, referring to FIGS. 7 and 8, when pumping a tire (not shown) via a French valve FV, the main body 10 is rotated relative to the head 11 in a direction until the first opening 1751 the first side 175 of the cam seat 173 faces the retainer 14 while the second side 176 of the cam seat 173 faces upwardly (as viewed from the direction of FIG. 7). Then, the French valve FV is extended into the compartment 152 of the nozzle head 15. The needle FV' of the French valve FV pushes the nozzle 143 and the pin 18 inward and thus makes the enlarged first end 181 of the pin 18 enter the interior 174 of the cam seat 173 via the first opening 1751 of the first side 175, as shown in FIG. 7. It is appreciated that the enlarged first end 181 of the pin 18 bears against an interior wall of the cam seat 173 that faces the first side 175.

Thereafter, the main body 10 is rotated relative to the head 11 in a reverse direction to make the second opening 1761 of the second side 176 of the cam seat 173 face the retainer 14 while the first side 175 faces downward (as viewed from the direction of FIG. 8). The enlarged first end 181 of the pin 18 still remains in the interior 174 of the cam seat 173, yet the cam seat 173 is rotated such that the enlarged first end 181 of the pin 18 is moved to bear against another interior wall of the cam seat 173 that faces the second side 176. It is appreciated that the enlarged first end 181 of the pin 18 moves the retainer 14 toward the French valve FV by a distance L2−L1 as a result of different length and width of the interior 174 of the cam seat 173. Accordingly, the conical recess 146 of the retainer 14 is completely filled by the conical section 151 of the nozzle head 15, while the nozzle 143 contacts with the needle FV' of the French valve FV, as shown in FIG. 8. Air from the passage 101 (under reciprocating motion of the above-mentioned piston) enters the French valve FV via the compartment 12 of the head 11, the transverse hole 145 of the retainer 14, the transverse hole 183 and the axial hole 184 of the pin 18, and the needle 1433 of the nozzle head 143, as indicated by arrows in FIG. 8. During the inflation procedure, a portion of inlet air enters a space between an inner periphery of the head 11 and an outer periphery of the retainer 14 and thus exerts an inward radial force on the conical elastic nozzle head 15 to thereby tightly clamp the French valve FV in place.

Figure 9:
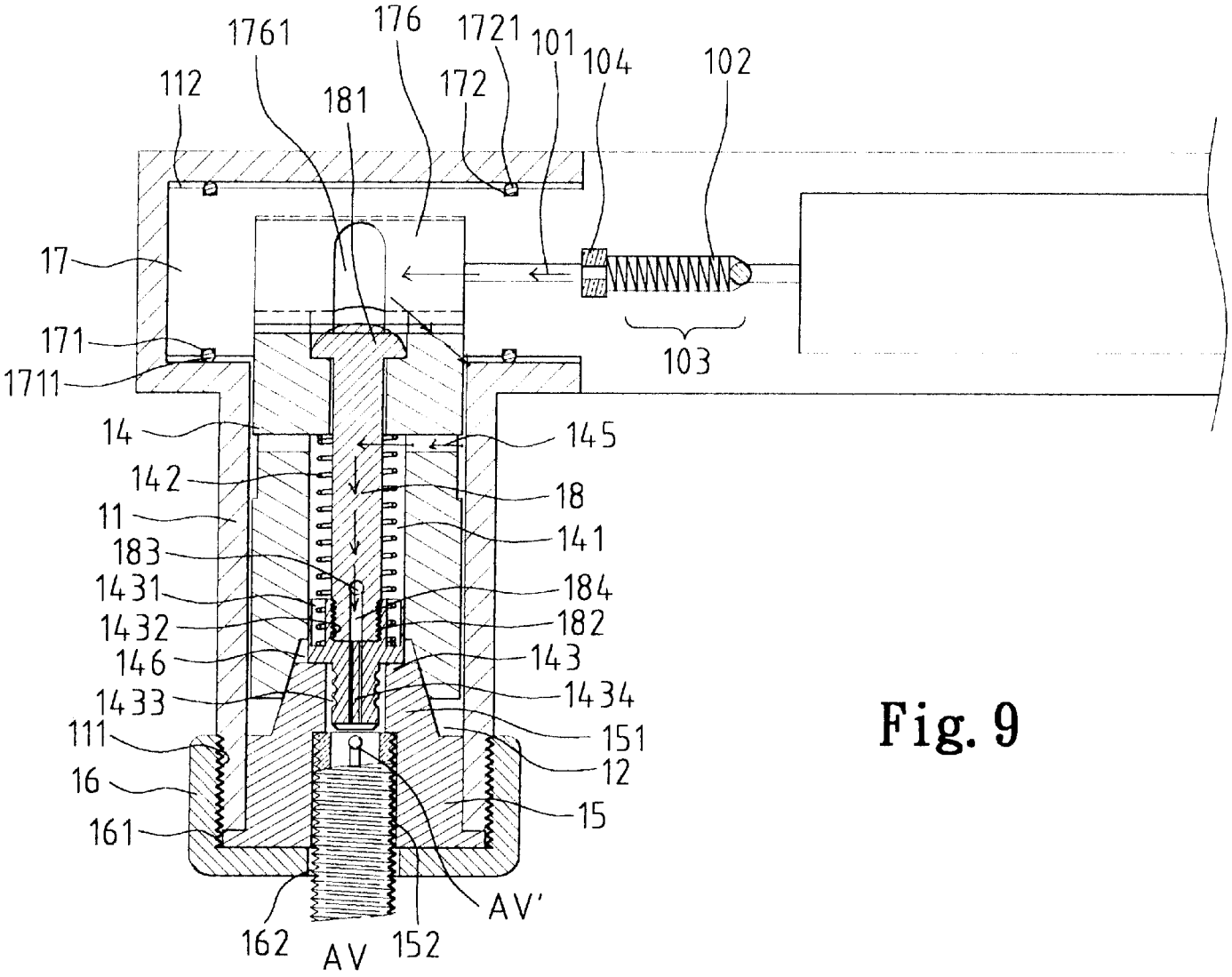
FIG. 9 is a cross sectional view of the pumping device in accordance with the present invention used on an American valve.
Figure 10:
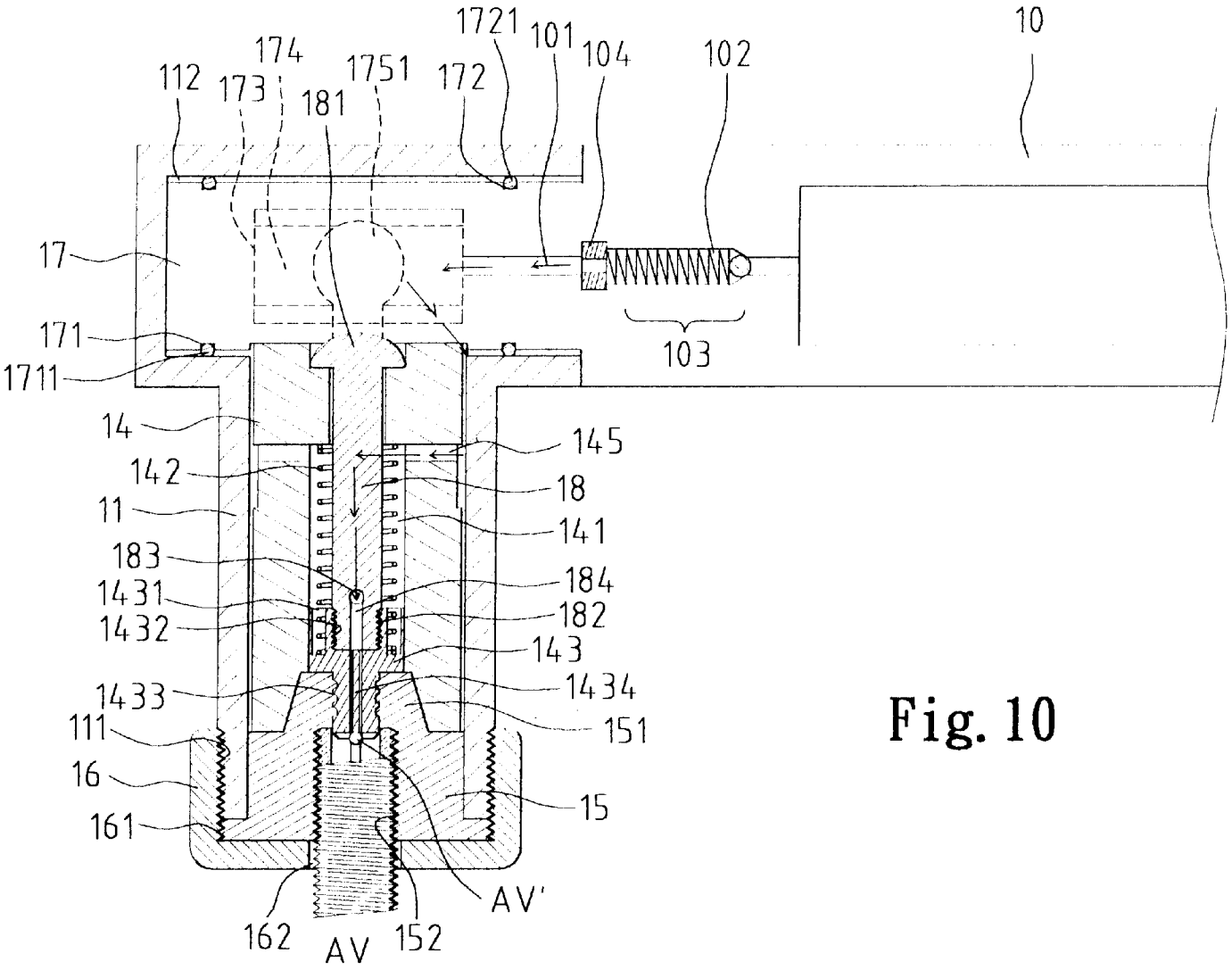
FIG. 10 is a cross sectional view similar to FIG. 9, wherein the American valve is tightly clamped.

Referring to FIGS. 9 and 10, when pumping a tire (not shown) via an American valve AV, the main body 10 is rotated relative to the head 11 in a direction until the first opening 1751 the first side 175 of the cam seat 173 faces the retainer 14 while the second side 176 of the cam seat 173 faces upwardly (as viewed from the direction of FIG. 9). Then, the American valve AV is extended into the compartment 152 of the nozzle head 15. The needle AV' of the American valve AV does not contact with the nozzle 143, as the needle AV' is short and hidden in the American valve AV. Thus, the pin 18 remains in its initial position shown in FIG. 9.

Thereafter, the main body 10 is rotated relative to the head 11 in a reverse direction to make the second opening 1761 of the second side 176 of the cam seat 173 face the retainer 14 while the first side 175 faces downward (as viewed from the direction of FIG. 10). The enlarged first end 181 of the pin 18 is moved to bear against the second side 176 of the cam seat 173. Since the second opening 1761 is too small to allow the enlarged first end 181 of the pin 18 to pass through, the enlarged end 181 of the pin 18 moves the retainer 14 toward the American valve AV by a distance L2–L1, best shown in FIG. 10. As a result, the conical recess 146 of the retainer 14 is completely filled by the conical section 151 of the nozzle head 15, while the nozzle 143 contacts with the needle AV' of the American valve AV. Air from the passage 101 (under reciprocating motion of the above-mentioned piston) enters the American valve AV via the compartment 12 of the head 11, the transverse hole 145 of the retainer 14, the transverse hole 183 and the axial hole 184 of the pin 18, and the needle 1433 of the nozzle head 143, as indicated by arrows in FIG. 10. During the inflation procedure, a portion of inlet air enters a space between an inner periphery of the head 11 and an outer periphery of the retainer 14 and thus exerts an inward radial force on the conical elastic nozzle head 15 to thereby tightly clamp the American valve AV in place.

According to the above description, it is appreciated that the pumping device in accordance with the present invention may be used on various valves by simple rotation of the main body. In addition, the user does not have to discriminate the types of the valves to be inflated, while no external operative lever is required.

Although the invention has been explained in relation to its preferred embodiment, it is to be understood that many other possible modifications and variations can be made without departing from the spirit and scope of the invention as hereinafter claimed.

What is claimed is:

1. A pumping device comprising:

a main body having a passage defined therein through which air passes, a head including a first end and a second end, the second end of the head being communicated with the passage, a pivotal tube secured to the main body and rotatably received in the first end of the head, the pivotal tube including a hollow cam seat securely mounted therein, the cam seat including a central rotating axis relative to the first end of the head, the cam seat including a first side with a first opening and a second side with a second opening communicated with the first opening, a distance from the central rotating axis of the cam seat to the first side being smaller than a distance from the central rotating axis of the cam seat to the second side, a retainer slidably received in the head and including a first compartment therein, a first end, and a second end, the second end of the retainer including a conical recess defined therein, a spring being mounted in the first compartment, a nozzle being slidably mounted in the second end of the retainer and including a first end attached to the spring and a second end, a pin being slidably mounted in the retainer and including a first end extended beyond the first end of the retainer and a second end secured to the nozzle to slide therewith, the second opening of the cam seat being sized to be smaller than the first end of the pin to prevent the first end of the pin from passing through the second opening, the first opening of the cam seat being sized to be larger that the first end of the pin to allow the first end of the pin to pass through, and a nozzle head securely mounted in the second end of the head and including a second compartment communicated with the first compartment via the nozzle, the nozzle head including a hollow conical section for engaging with the conical recess of the retainer.

2. The pumping device as claimed in claim 1, wherein the retainer includes a transverse hole for communicating the first compartment of the retainer and the passage of the main body.

3. The pumping device as claimed in claim 2, wherein the pin includes a second transverse hole communicated with the first-mentioned transverse hole via the first compartment of the retainer, the pin further includes an axial hole that communicates the second transverse hole with the second end of the nozzle.

4. The pumping device as claimed in claim 1, wherein the passage of the main body includes a check valve mounted therein such that air is only flowable from the passage to the first compartment.

5. The pumping device as claimed in claim 1, further comprising an outer cap securely mounted to the second end of the head to secure the nozzle head in position, the outer cap including an opening communicated with the second compartment of the nozzle head.

* * * * *